US006581810B1

(12) United States Patent
Ho

(10) Patent No.: US 6,581,810 B1
(45) Date of Patent: Jun. 24, 2003

(54) SELF-SHAPING GARMENT HANGER SHOULDER GUARD

(76) Inventor: Myong H. Ho, 1906 MacDade Blvd., Folsom, PA (US) 19033

( * ) Notice: Subject to any disclaimer, the term of this patent is extended or adjusted under 35 U.S.C. 154(b) by 34 days.

(21) Appl. No.: 10/090,950

(22) Filed: Mar. 5, 2002

(51) Int. Cl.[7] ..... A41D 27/22
(52) U.S. Cl. ..... 223/87; 223/98
(58) Field of Search ..... 223/87, 98

(56) References Cited

U.S. PATENT DOCUMENTS 2,774,527 A * 11/1956 Iverson ..... 200/445
3,155,296 A * 11/1964 Calder ..... 223/98

* cited by examiner

*Primary Examiner*—Rodney M. Lindsey
*Assistant Examiner*—James G Smith

(57) ABSTRACT

A shoulder guard for a hanger is formed from two wings which are substantially symmetrical and which are substantially identical except for attachment details. The wings have a pair of folds which are at an angle to normal to centerlines of the wings, and which permit the wings to fold flat against each other. When the wings are unfolded, the shoulder guard forms an arch. Cutouts are provided for tying multiple hangers together and cuts are provided for slipping the shoulder guard over the hook of the hanger by forcing the hook past the cuts. Additional cutouts facilitate the shoulder guard retaining its form at the ends and also provide support for particular garments.

20 Claims, 3 Drawing Sheets

SELF-SHAPING GARMENT HANGER SHOULDER GUARD

BACKGROUND OF THE INVENTION

1. Field of the Invention

This invention relates to a cover for use with garment hangers for the purpose of protecting a garment draped on the hanger from hanger marks and creasing. More specifically, it relates to a cover which is foldable for easy use, shipping and handling, and which is quickly and easily assembled onto the hanger.

2. Description of Related Art

Wire hangers for hanging clothing are commonly used in the dry cleaning and garment manufacturing industries. A typical wire hanger consists of a single length of wire which is bent into a generally triangular base, having a hook portion. Significantly, the triangular base includes two downwardly angled opposed arms which are often used to support the garment.

The use of the wire arms to support the garment often results in the garment developing hanger marks or creases from direct contact with the hanger. This is a result of the relative thinness of the wire used to construct the wire hanger. In addition, the lower ends of the wire arms often create creases near the garment's sleeves. A further result of placing freshly-pressed garments on wire hangers is that, even if the crease does not appear, the hanging of the garment on the hanger results in a tight curve around the shoulders. While this does not affect garments which are intended to follow the natural shape of the body, there are some instances where it is desired to have the garment "set" with a broader curve around the shoulders.

For this reason, covers are used to prevent direct contact between the garment and the hanger in order to reduce hanger marks. It is desired for the cover to have a surface which is much wider and more rounded than the hanger in order to prevent creasing of the garment from the sharp edges of the wire hanger. The shape of the cover preferably simulates the shape of the general shoulder area of a person so that the garment will have a more natural appearance when removed from the hanger. To this end, the sides of the cover are preferably directed outwardly and downwardly from the hanger.

Generally, covers for hangers are sold, packaged and shipped in large quantities. The use of a cover involves extra steps in preparing the garment for the customer. Normally the cover is packaged in a flat folded form, or unfolded. This means that in order to create the desired final form of the cover, the cover must be manipulated by personnel at the dry cleaner plant or other facility. It is desirable to reduce the time necessary for manipulation of the cover when using such a cover. In addition, there is an inherent instability to garment covers in that the cover is a substantially different shape than the narrow hanger on which it is mounted. While the hanger hook prevents some movement, if the cover rotates or otherwise slips sideways, it can either fall off or require additional manipulation of the garment to center the garment on the hanger.

In the case of garments supported by straps, it is desired to provide a place to retain the straps. This is the case where multiple garments are placed on a single hanger. There are also some garments which tend to move sideways because of a large neck opening or the like. For example, dresses with large necklines tend to be unstable on a downwardly sloping hanger. Such garments often have hanger straps which can be used to stabilize the garment. While such straps can sometimes be placed over the hanger's hook, this requires additional manipulation of the garment. It is desired to provide for such straps with a hanger. In addition, some garments tend to hang better when supported on relatively horizontal portions of a hanger, so it is also desired to provide for such support.

If multiple garments are provided to a customer, it often the case that the garments are tied together by tying the hangers together. It is possible to tie the garments at the hook above the downwardly angled opposed arms which are part of the hanger's triangular base; however, it is often desired to tie the hangers together. If a garment cover is mounted to the base, then threading a hanger tie through the base is made difficult.

Ideally, the hanger guard should be inexpensive, convenient to store, easily and quickly placed in its final form and installed onto the hanger, and easily held in a desired position on the hanger. It is also desired to provide a means for supporting hanger straps of a garment and supporting garments with wide necklines or which are otherwise difficult to support on a downwardly sloping hanger. It is further desired that the hanger guard be made from a monolithic material such as cardboard, which is readily recycled.

The following United States patents may be of interest to provide background to past hanger guards:

U.S. Pat. No. 1,715,004 to Johnson; U.S. Pat. No. 2,434,461 to Forcheimer; U.S. Pat. No. 2,873,054 to Zintel; U.S. Pat. No. 4,033,430 to Zintel; U.S. Pat. No. 3,117,806 to Kestner; U.S. Pat. No. 3,203,330 to Hawkins; U.S. Pat. No. 3,294,296 to Gelman et al.; U.S. Pat. No. 5,388,734 to Seitz; U.S. Pat. No. 4,632,287 to Bevelander; U.S. Pat. No. 4,658,997 to Nash; U.S. Pat. No. 4,944,436 to Moon et al.; U.S. Pat. No. 4,988,022 to Seitz ; U.S. Pat. No. 5,139,184 to Seitz; U.S. Pat. No. 5,390,835 to Murphy; U.S. Pat. No. 5,577,645 to Seitz; U.S. Pat. No. 5,927,572 to Kiselik; U.S. Pat. No. 6,269,989 to Kiselik; U.S. Pat. No. 6,019,262 to Kiselik.

SUMMARY OF THE INVENTION

According to one aspect of the invention, a hanger guard is provided from a form which permits folding of the hanger guard to a flat configuration. When the hanger guard is unfolded, it forms a curved profile, which is prearranged to be a desired curved shape when the hanger guard is unfolded to approximately that of a standard wire clothes hanger. This curved shape provided a preferred form for supporting garments while resting on the hanger. The form is such that angles on both sides of a hinged portion are substantially identical. In addition, the hinged arrangement includes slots which can be conveniently used to thread hanger ties beneath hook portions of hangers, including those with the hanger guard. Side cutouts serve to enhance the tendency of the hanger to retain a curved shape and provide resting spots for wide neckline garments and for hanger straps on garments. The hanger may also have cut regions which can be used to extend downwardly over the clothes hanger in order to stabilize the hanger guard in its position on the clothes hanger.

DETAILED DESCRIPTION OF THE EXEMPLARY EMBODIMENTS

Figure 1:
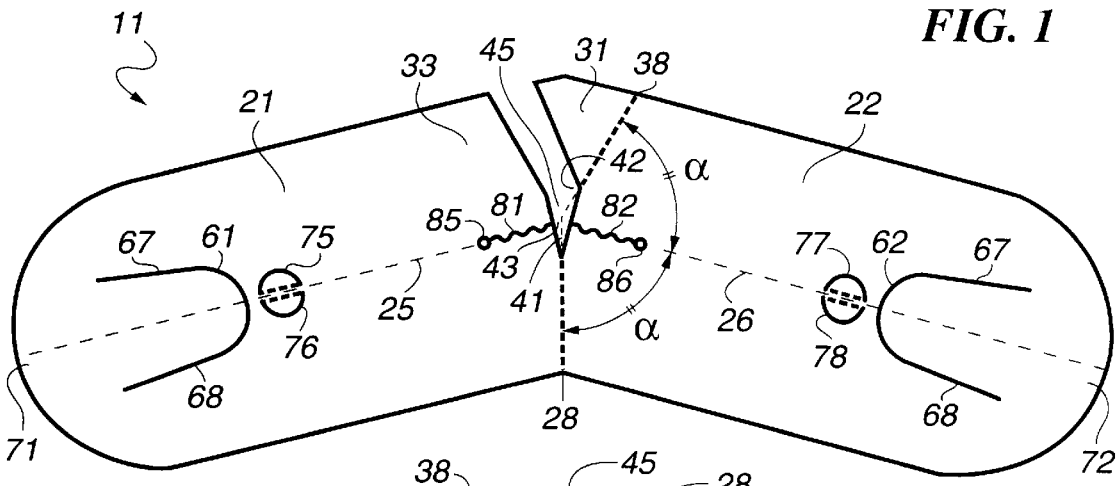
FIG. 1 is a plan view of a form for a shoulder guard formed according to one embodiment of the invention.

FIG. 1 is a drawing showing one embodiment of the inventive self-shaping garment hanger shoulder guard 11 in an unassembled condition. The shoulder guard 11 is formed from flat web material such as cardboard stock, and has two substantially identical wings 21,22. Each of the wings 21,22 is substantially symmetrical about respective centerlines 25,26, and the wings 21, 22 are joined at a preformed folding line 28, which is established to extend at a predetermined angle " from normal to the centerlines 25,26. This predetermined angle " is greater than zero and thereby establishes a theoretical fold line which establishes a curvature of the shoulder guard 11 when the shoulder guard 11 is resting on a hanger (50, FIG. 4).

In addition to the preformed folding line 28, an attachment tab 31 is included, and extends from one of the wings 22. The attachment tab 31 extends from the one wing 22 toward the other wing 21, and is intended to overlap the other wing 21 at overlap area 33 when the wings 21,22 are either folded against each other and at all times after the shoulder guard 11 is assembled. The overlap area 33 corresponds to the attachment tab 31. When the attachment tab 31 is in engagement with the overlapping area 33, the attachment tab presents a fold line 38, which is symmetrically aligned with the preformed folding line 28 as a second folding line (folding line 38). This condition only exists when the wings 21,22 are folded against each other if the wings 21,22 are flat. If the wings 21,22 are unfolded against each other, the wings 21, 22 must bend along their respective centerlines 25,26. With the attachment tab 31 not extending to the overlap area 32, the wings 21,22 can each remain flat regardless of the angle that the wings are folded at the preformed folding line 28. This makes it possible to fabricate the shoulder guard 11 from a single piece of flat stock. If cut from a single piece of sheet stock, the tab 22 is also limited in area so that when the shoulder guard 11 is flat and unfolded, the tab 31 does not overlap the opposite wing 22.

The shoulder guard 11 also has a pair of V-shaped openings 41,42 extending inwardly from the fold lines 28,38, to form a wide part 43 of the openings 41,42 at the centerlines 25,26. The two V-shaped openings 41,42 form a single diamond shaped center opening 45 which is at the center of the shoulder guard 11. This opening 45 allows the shoulder guard 11 to fit over the hanger's hook and will also provide room for tying hangers together below the hook. As mentioned, the folding lines 28,38 are at an angle $\alpha$ from the centerlines 25,26. The angle $\alpha$ is greater than an angle between the centerline and a shoulder of a hanger 50 on which the shoulder guard 11 is expected to be positioned.

Figure 4:
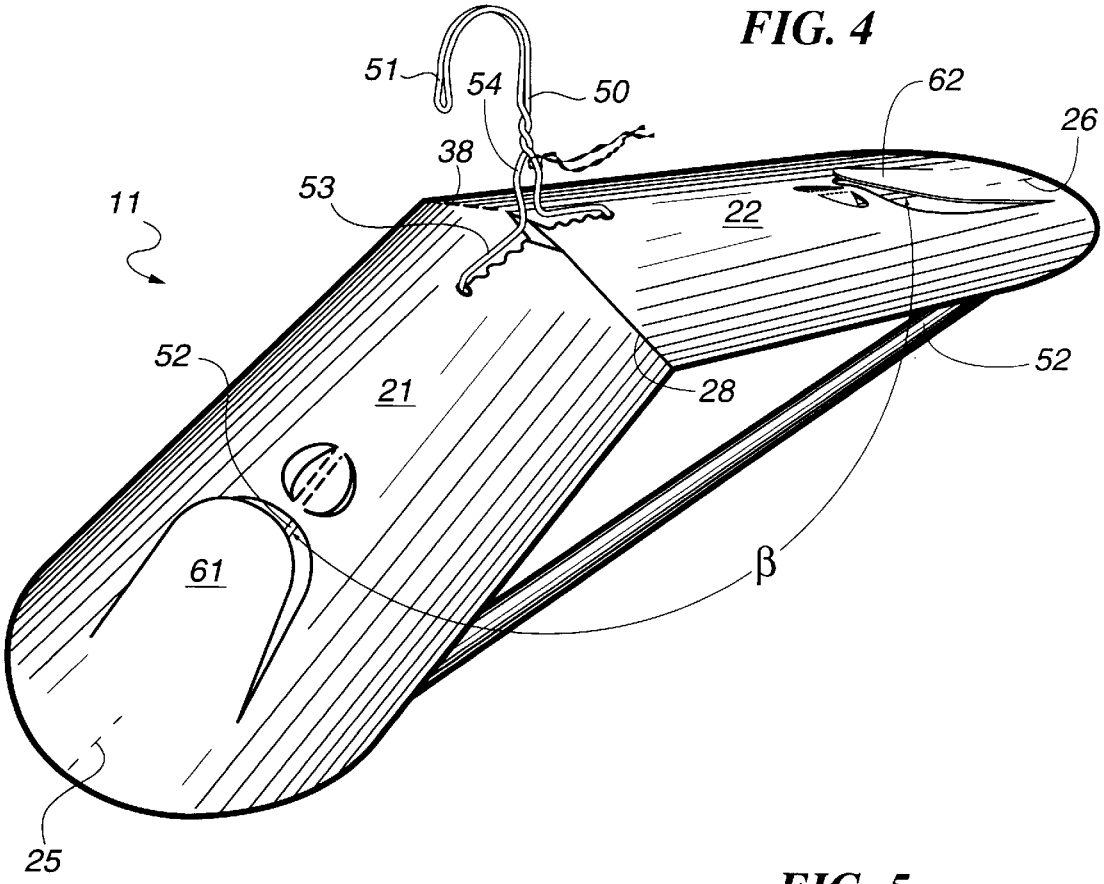
FIG. 4 is a drawing of the shoulder guard on a hanger.

This angle of the hanger 50 is usually not expressed in terms of the centerline, but instead is expressed as an angle $\beta$ between the shoulders, shown in FIG. 4. In typical hangers this angle is 140°. An included angle between the two folding lines 28,38 is preferably greater than the angle between the shoulders of the hanger 50 for which the shoulder guard 11 is intended, but less than 180°. The preferred included angle between the two folding lines 28,38 approximately bisects the angle between the shoulders of the hanger 50 and a straight line. Note that when the shoulder guard 11 is positioned on the hanger, the folding lines 28,38 do not line up with the shoulders of the hanger 50 but are in a crosswise alignment with the hanger 50, and so in use are not bisecting the angle of the hanger. As a result of the folding lines 28,38 being at an angle $\alpha$ from the centerlines 25,26, the wings 21,22 must bend when unfolded. With the attachment tab 31 fixed to the overlap area 33, the condition of the folding points being at an angle $\alpha$ can exist in only three conditions:

1. The wings separated from each other at one of the folding lines 28,38; or
2. The wings 21,22 are folded against one another;
3. The wings arched, so as to align the folding lines.

Condition 1, with the wings separated from each other, exists when the shoulder guard 11 is initially cut from card stock. In the embodiment of FIG. 1, the wings 21,22 are initially attached at preformed fold line 28, but are separate from each other at fold line 38.

Figure 2:
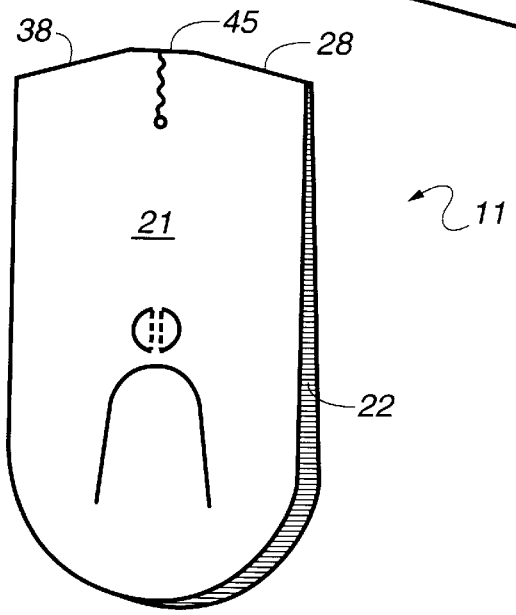
FIG. 2 is a view of the shoulder guard of FIG. 1, folded for bonding and shipment.

Condition 2 occurs in order to bond the two wings 21,22 together, as shown in FIG. 2. As a result, if the tab 31 is folded over, tab 31 becomes positioned in alignment with overlap area 33 so that bonding can take place without further alignment. This is the only condition in which the fold lines 28,38 align with the wings 21,22 flat. This condition also exists in a preferred mode of shipment, which is also with the wings 21,22 folded together.

If the wings 21,22 are unfolded from one another with the wings 21,22 both attached at the fold lines 28,38, then the wings 21,22 must bend. This bending creates a desired curved shape for the shoulder guard 11 as it rests on the hanger (50, FIG. 4). The fold lines 28,38 retain an angular relationship with lines normal to the centerlines 25,26, so it is not possible to open the hanger guard 11 to an extent to make the centerlines 25,26 collinear.

The three conditions mentioned above are also the order of assembly. In condition 1, the wings 21,22 are flat and not folded. The wings 21,22 are then folded against each other and bonded together, which is condition 2. The shoulder guard 11 may be easily shipped in this condition because the shoulder guard 11 is at this point nearly ready to use, and yet is easily stored. When the dry cleaner or other user is ready to use the shoulder guard 11, the shoulder guard 11 is taken out of its box and unfolded sufficiently to fit over a hanger 50, as shown in FIG. 4. The unfolding results in the wings 21,22 forming an arch along centerlines 25,26. The shoulder guard 11 is fitted over the hanger 50 by passing the shoulder guard 11 over the hanger's hook 51 and resting the shoulder guard on the hanger's body 52. If the hanger's body 52 includes a crown portion 53, the shoulder guard 11 may be positioned above or below the crown portion 53. In addition, the hanger will usually have a throat portion 54, which is the section of the hanger 50 below the hook 51 and below a twisted part of the hanger immediately below the hook 51.

The unfolding of the wings 21,22 results in the shoulder guard 11 assuming an angle $\delta$ which can be measured along the centerlines 25,26. The angle $\delta$ will be less than the angle $\beta$ of the hanger 50, and so the shoulder guard 11 will be elevated above the hanger wires which run along the angle $\beta$. The shoulder guard 11 will not necessarily rest above the hanger's shoulder which may be higher than suggested by the angle $\beta$.

Referring again to FIG. 1, the shoulder guard 11 includes an end cutout forming strap retainers 61,62 on each wing 21,22. The strap retainers each have two linear cuts 67,68, terminating in an arcuate cut 69 toward the center of the shoulder guard 11. The strap retainers 61,62 perform several functions. In the case of garments supported by straps, the strap retainers 61,62 can be used to retain the straps. If the garment has tendency to move sideways because of a large neck opening or other reasons, the strap retainers create either a flattened area or a raised lip which reduces the tendency of the garment to fall off the hanger.

In addition, because of the physical shape of the strap retainers 61,62, the ends 71,72 of the shoulder guard 11 beyond the strap retainers 61,62 tends to remain flat between the linear cuts 67,68. This urges the shoulder guard 11 to a broader horizontal expanse at the ends 71,72 as viewed transversely to the centerlines 25,26. The broader horizontal expanse at the ends 71,72 provide better support for the garment at the edge of the shoulders.

Inboard of the strap retainers 61,62 are two pinch cutouts 75–76 and 77–78 on each wing 21,22. The pinch cutouts 75–78 are preferably arcuate and allow the material of the shoulder guard 11 to be pinched around the hanger 50. This can stabilize the shoulder guard over the hanger, and can be either not used, used by merely pinching the pinch cutouts 75–78 or by pinching the pinch cutouts 75–78, followed by fastening the pinch cutouts to each other in pairs around the hanger 50.

Extending along the centerlines 25,26 from the center opening 45 are a pair of wavy cuts 81,82. The wavy cuts 81,82 terminate with small round openings 85,86, which function as "stop drill" holes to reduce a tendency of the wings 21,22 from further splitting along the centerlines 25,26 beyond the wavy cuts 81,82. The wavy cuts 81,82 make it easy to slip the shoulder guard 11 over the hook 51 of a hanger 50 without requiring that the hook 51 to be threaded around to get the center opening 45 past the hook 51. The hook 51 is able to be forced through the wavy cuts 81,82. In addition, many hangers are formed with a crown portion 53 at the top of the hanger's body 52. This serves to further stabilize the shoulder guard 11 in position over the hanger.

As can be seen, the opening 45 is preferably sufficient to permit extending a tie (not shown) across the shoulder guard 11 and through the hanger beneath the hook 51. When multiple garments are draped over corresponding shoulder guards 11, their respective hangers 50 are placed in a group of juxtaposed garments. If multiple garments are provided to a customer, it often the case that the garments are tied together by tying the hangers together. The center opening 45 makes it easier to insert a tie through the hanger's body 52 below the hook 51. It is desired to thread common twist-tie or cord through the hangers 50 to tie the garments together. This can be accomplished at the hook 51, but it is desirable in some instances to tie the garments together at the throat portion 54 below the hook 51, in part to prevent individual hangers 50 from slipping out of the tie. If one or more of the hangers 50 have shoulder guards 11 in place, the shoulder guard 11 potentially is in the way of threading the tie. The opening 45 permits the tie to clear the shoulder guard 11 by passing through the opening 45.

In addition, if the throat portion 54 is particularly wide, the opening 45 allows the shoulder guard 11 to fit over the throat portion 54. There are also some hangers which have a wide throat portions 54, which form an extension leading to the hook which is wider than the hook. The center opening 45 also accommodates such hangers. In many instances the center opening 45 would be sufficient to permit the throat portion 54 to pass without the throat portion 54 passing through the wavy cuts 81,82.

Figure 3:
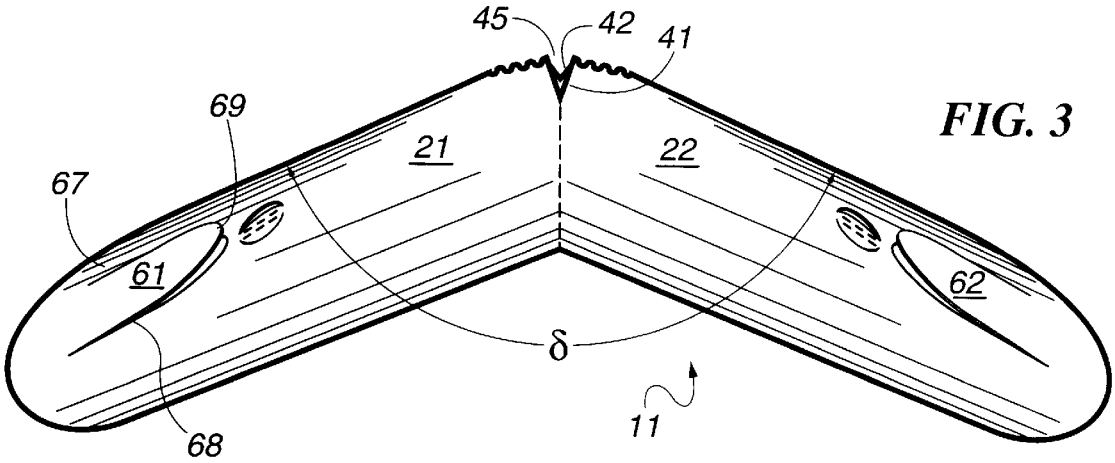
FIG. 3 is a drawing of the shoulder guard of FIG. 2 unfolded and exhibiting a curved shape.
Figure 5:
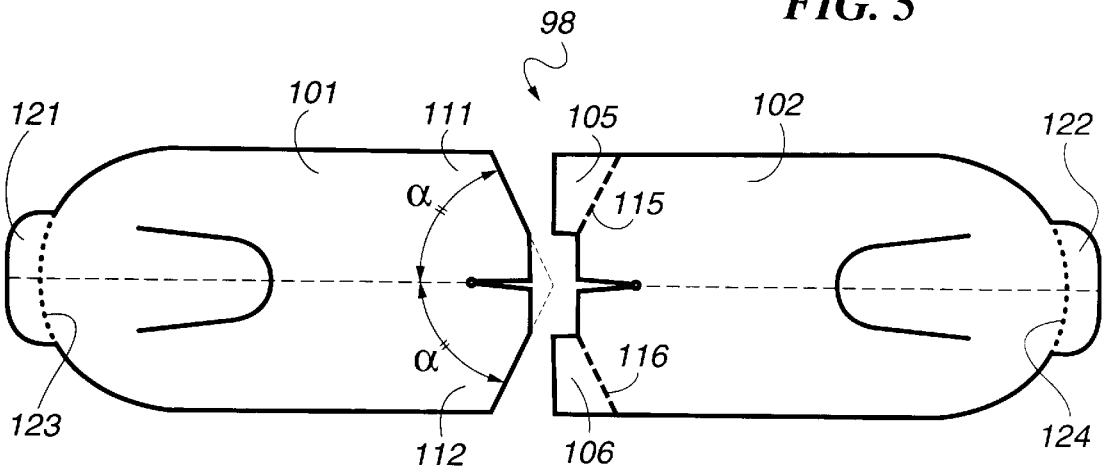
FIG. 5 is a drawing of an alternate embodiment of a form for a shoulder guard, in which two halves are separate prior to assembly.

FIG. 5 shows an alternative embodiment of a shoulder guard 98. In this case, two wings 101,102 are fabricated without being joined in the manner that wings 21,22 are formed joined at a preformed folding line 28. Since it is necessary to bond or otherwise attach at least one fold line, the wings 101 in shoulder guard 98 are both attached in a folded state. A pair of tabs 105,106 are provided and are preferably bonded to tab overlap areas 111,112. The tabs are folded along fold lines 115,116, which function in the manner of fold lines 28,38 described in connection with FIGS. 1–3.

Figure 6:
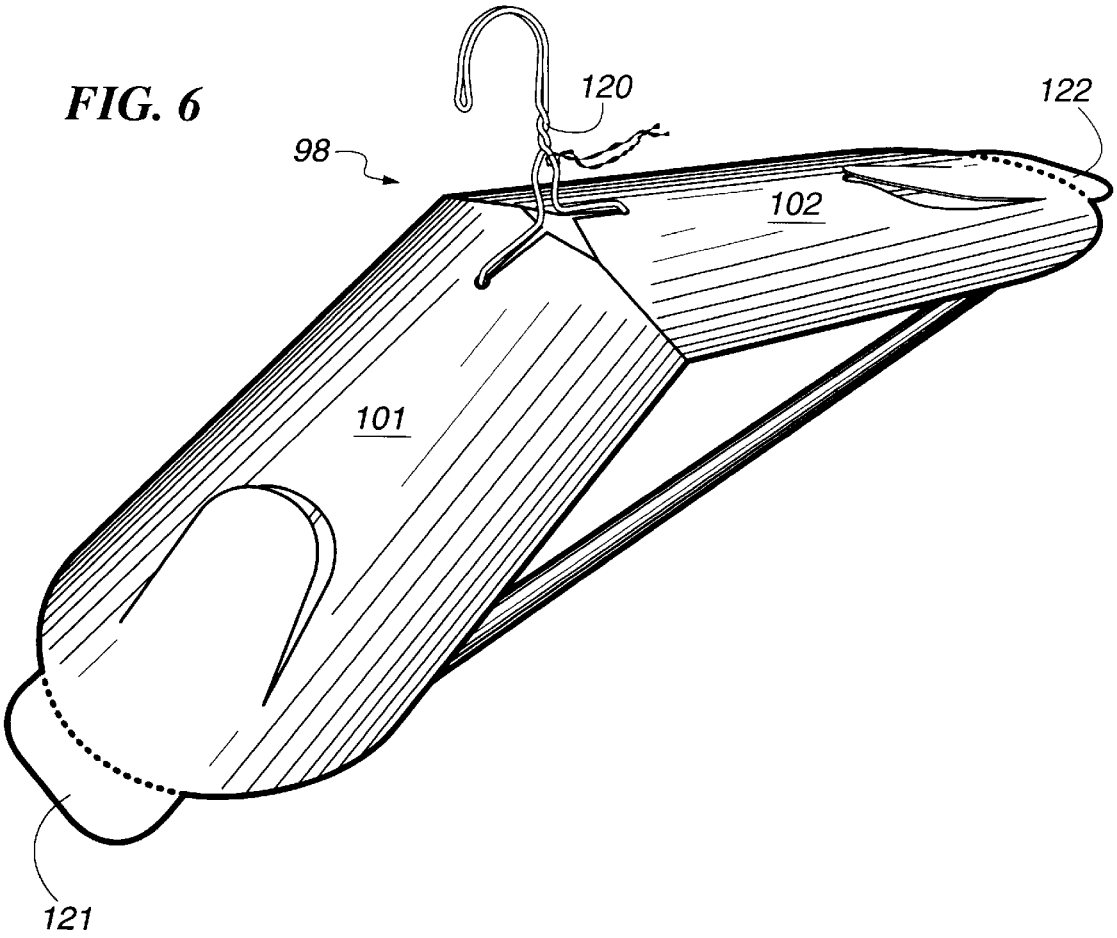
FIG. 6 is a drawing of the shoulder guard of FIG. 5 fitted over a hanger.

The shoulder guard 98 is assembled by folding the tabs 105,106 and then bonding the tabs 105,106 to the tab overlap areas 111,112 with the wings 101,102 folded flat against each other. With the wings 101,102 folded against each other, the tabs 105,106 and bonded to the tab overlap areas 111,112. The shoulder guard 98 may be easily shipped in this condition because the shoulder guard 98 is at this point nearly ready to use, and yet is easily stored. When the dry cleaner or other user is ready to use the shoulder guard 98, the shoulder guard 98 is taken out of its box and unfolded sufficiently to fit over a hanger 120, as shown in FIG. 6. The unfolding results in the wings 101,102 forming an arch when the shoulder guard 98 is fitted over a hanger 120.

A pair of extension tabs 121, 122 are provided, which causes the shoulder guard to provide extended support of the top of the sleeve near the centerline. If the business entity (dry cleaner or store) desires, the tabs 121,122 can be removed, and frangible lines 123, 124 are provided for this purpose. The frangible lines 123, 124 can be serrations, perforations, scores or any other device which permits easy separation of the extension tabs 121, 122. While shown in the embodiment of FIGS. 5 and 6, extension tabs may also be provided with the embodiment of FIGS. 1–4.

The extension tabs 121,122, are located at each outer end of the wings to provide additional width support for a garment. In a preferred embodiment, the tabs are 1.5 cm deep along the centerline of the shoulder guard 98. The tabs 121,122 are preferably between 6 and 7 cm wide. These dimensions may vary and it is anticipated that the extension tabs may extend between 1 cm and 3 cm from the respective wings, and may be between 4 and 10 cm wide.

FIG. 6 is a drawing of the shoulder guard 98 of FIG. 5 fitted over the hanger 120. As can be seen, the shoulder guard 98 curves about the hanger 120 in the manner of shoulder guard 11 over hanger 50. The assembled shoulder guard 98 constructed from two pieces is similar to the shoulder guard 11.

While particular embodiments of the hanger guard have been shown and described, it is contemplated that variations will be made, and that these variations will be within the scope of the present invention. Accordingly, the invention should be construed only as limited by the claims.

While the preferred and alternate embodiments of the invention have been illustrated in detail, modifications and adaptations of such embodiments will be apparent to those skilled in the art. However, it is to be expressly understood that such modifications and adaptations are within the spirit and scope of the present invention asset forth in the following claims.

What is claimed is:

1. A shoulder guard for a hanger used to provide a form shape over a thin hanger having a hook and a body, the shoulder guard comprising:

a pair of wings substantially symmetrical about centerlines on each of the wings, each of the wings formed of substantially flat web material, and joined along a pair of fold lines;

the fold lines aligned at angles to the centerlines of each wing such that the fold lines form angles to lines normal to the centerlines of each wing which angles are greater than zero, and the angles formed by the fold lines to lines normal to the centerline of each wing are substantially the same, thereby establishing symmetry between the fold lines on each wing and establishing symmetry on each wing for fold lines on opposite sides of the wing;

the angles of the fold lines permitting the shoulder guard to remain flat when the shoulder guard remains in a folded state, and causing the wings to arch when the wings unfold;

a center opening between the fold lines;

a pair of cuts extending a predetermined distance outwardly along the centerlines sufficiently to permit moving the shoulder guard over the hook of the hanger by forcing the hook through at least one of the cuts, the cuts further permitting positioning the wings over a raised portion of the hanger below the hook if the hanger has such a raised portion;

cutouts near outer ends on each wing forming strap retainers, the strap retainers each having two linear cuts terminating in an arcuate cut convex toward the center opening of the shoulder guard.

2. The shoulder guard of claim 1, further comprising a pair of additional cutouts symmetrically displaced from the centerline on each wing, so that respective pairs of the additional cutouts may be pressed downwardly around a portion of the body of the hanger.

3. The shoulder guard of claim 1, wherein the center opening extends from a midpoint between the fold lines sufficiently to provide convenient access to a portion of the hanger for purposes of extending a tie across the shoulder guard and through the hanger beneath the hook without deflecting tying material to pass through the opening on one side of the hanger, the hanger and the opening on an opposite side of the hanger.

4. The shoulder guard of claim 1, wherein an included angle between the two fold lines is greater than an angle between the shoulders of a hanger for which the shoulder guard is intended, but less than 180°.

5. The shoulder guard of claim 4, wherein the included angle between the two fold lines approximately bisects a straight line and the angle between the shoulders of a hanger for which the shoulder guard is intended.

6. The shoulder guard of claim 1, wherein, when resting on a hanger with two straight rod extensions forming a shoulder portion of the hanger and terminating at hanger ends, an included angle of the shoulder guard measured between the centerlines is less than an included angle of the rod extensions.

7. The shoulder guard of claim 1, further comprising a pair of extension tabs, with one tab located at each outer end of the wings, the extension tabs providing additional width support for a garment.

8. The shoulder guard of claim 7, wherein the extension tabs extend between 1 cm and 3 cm from the respective wings, and are between 4 and 10 cm wide.

9. The shoulder guard of claim 7, wherein the extension tabs extend approximately 1.5 cm from the respective wings.

10. The shoulder guard of claim 7, further comprising scored, serrated, or perforated connection between the extension tabs and the respective wings, the connection permitting easy separation between the extension tabs and the wings.

11. A flat form for a shoulder guard used to provide a form shape over a thin hanger having a hook and a body, the shoulder guard comprising:

a pair of wings formed of substantially flat web material, each of the wings substantially symmetrical about centerlines on each of the wings and joined along a pair of fold lines, the wings substantially identical except for portions used for joining the pair of wings;

the fold lines aligned at angles to the centerlines of each wing such that the fold lines form angles to lines normal to the centerlines of each wing which are greater than zero, the fold lines angled such that the fold lines each extend outwardly at said angle from the centerline toward an edge of the wing, said angle directed outwardly toward an outer end, of the wing, and the angles formed between the fold lines and lines normal to the center of each wing substantially the same, thereby establishing symmetry between the fold lines on each wing and further establishing symmetry across the fold lines;

the angles of the fold lines permitting the shoulder guard to remain flat when the shoulder guard remains in a folded state, and causing the wings to arch when the wings unfold;

a center opening between the fold lines;

a pair of cuts extending a predetermined distance outwardly along the centerlines sufficiently to permit moving the shoulder guard over the hook of the hanger by forcing the hook through at least one of the cuts, the cuts further permitting positioning the wings over a raised portion of the hanger below the hook if the hanger has such a raised portion; and cutouts near outer ends on each wing forming strap retainers, the strap retainers each having two linear cuts terminating in a connecting cut toward the center of the shoulder guard joining the linear cuts.

12. The flat form of claim 11, wherein the cutouts near the outer ends on each wing include two linear cuts terminating in an arcuate cut toward the center of the shoulder guard.

13. The flat form of claim 11, comprising:

the pair of wings formed as a single piece of the web material, with the wings joined at one of the fold lines;

an attachment tab at a second one of the fold lines, the attachment tab providing for attachment of the wings at the other one of the fold lines when the wings are folded against each other, so that said attachment further results in said causing the wings to arch when the wings unfold.

14. The flat form of claim 11, comprising:

the pair of wings formed with attachment tab at both of the fold lines; and the attachment tabs providing for attachment of the wings at the other one of the fold lines when the wings are folded against each other, so that said attachment results in said causing the wings to arch when the wings unfold.

15. The flat form of claim 11, wherein an included angle between the two fold lines is greater than an angle between the shoulders of a hanger for which the shoulder guard is intended, but less than 180°.

16. The flat form of claim 14, wherein the included angle between the two fold lines approximately bisects a straight line and the angle between the shoulders of a hanger for which the shoulder guard is intended.

17. The shoulder guard of claim 1, further comprising a pair of extension tabs, with one tab located at each outer end of the wings, the extension tabs providing additional width support for a garment.

18. The shoulder guard of claim 16, wherein the extension tabs extend between 1 cm and 3 cm from the respective wings, and are between 4 and 10 cm wide.

19. The shoulder guard of claim 16, wherein the extension tabs extend approximately 1.5 cm from the respective wings.

20. The shoulder guard of claim 16, further comprising scored, serrated, or perforated connection between the extension tabs and the respective wings, the connection permitting easy separation between the extension tabs and the wings.

* * * * *